US008714994B2

(12) United States Patent
Daily et al.

(10) Patent No.: US 8,714,994 B2
(45) Date of Patent: May 6, 2014

(54) MODULAR PLUG FOR POWER APPLICATIONS

(75) Inventors: Christopher George Daily, Harrisburg, PA (US); Edward John Howard, Millersburg, PA (US); Matthew Edward Mostoller, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 66 days.

(21) Appl. No.: 13/586,408

(22) Filed: Aug. 15, 2012

(65) Prior Publication Data

US 2014/0051305 A1 Feb. 20, 2014

(51) Int. Cl.
*H01R 4/50* (2006.01)

(52) U.S. Cl.
USPC ..... 439/344; 439/676

(58) Field of Classification Search
USPC ..... 439/676, 344, 941, 76.1, 391, 394, 398, 439/404, 607.38, 607.18, 607.26, 607.36, 439/620.11, 607.17, 620.23, 620.21
See application file for complete search history.

(56) References Cited

U.S. PATENT DOCUMENTS 7,798,866 B2 * 9/2010 Hetzer et al. ..... 439/676
7,857,635 B2 * 12/2010 Goodrich et al. ..... 439/76.1
2008/0057793 A1 3/2008 Gerber et al.

FOREIGN PATENT DOCUMENTS

CN 202 259 790 U 5/2012
EP 1 914 844 A2 4/2008

OTHER PUBLICATIONS

European Search Report, Mail Date, Nov. 7, 2013, EP 13 18 0326, Application No. 13180326.4-1801.

* cited by examiner

*Primary Examiner* — Renee S Luebke
*Assistant Examiner* — Harshad Patel

(57) ABSTRACT

A modular plug includes a plug housing having a mating end and a cable end and plug contacts at the mating end. The plug housing and the plug contacts are shaped and positioned to define an RJ-45 modular plug mating interface. The plug contacts are arranged into a first group and a second group with each of the plug contacts in the first group being electrically commoned to form a first power circuit and each of the plug contacts in the second group being electrically commoned to form a second power circuit. The first and second power circuits are terminated to different wires of a cable.

20 Claims, 4 Drawing Sheets

MODULAR PLUG FOR POWER APPLICATIONS

BACKGROUND OF THE INVENTION

The subject matter herein relates generally to modular plugs having current carrying capability for power applications.

In electrical systems, there is increasing concern for powering electronic devices. Some electrical systems supply power over typical connectors. For example, industry standard type RJ-45 communication connectors provide Power over Ethernet connections by supplying current along the 8 signal circuits. Such connectors have limited current carrying capability.

A connector capable of having higher current carrying ability is needed.

BRIEF DESCRIPTION OF THE INVENTION

In one embodiment, a modular plug is provided that includes a plug housing having a mating end and a cable end and plug contacts at the mating end. The plug housing and the plug contacts are shaped and positioned to define an RJ-45 modular plug mating interface. The plug contacts are arranged into a first group and a second group with each of the plug contacts in the first group being electrically commoned to form a first power circuit and each of the plug contacts in the second group being electrically commoned to form a second power circuit. The first and second power circuits are terminated to different wires of a cable.

In another embodiment, a modular plug is provided including a plug housing having a mating end and a cable end. The plug housing includes a cavity. A leadframe assembly is received in the cavity of the plug housing. The leadframe assembly has a first leadframe having a plurality of first plug contacts being electrically commoned to form a first power circuit. The first leadframe is configured to be terminated to a first wire of a power cable. The leadframe assembly has a second leadframe including a plurality of second plug contacts being electrically commoned to form a second power circuit. The second leadframe is configured to be terminated to a second wire of a power cable. The first and second plug contacts are positioned at the mating end of the plug housing to define an RJ-45 modular plug mating interface.

In a further embodiment, a modular plug is provided having a plug housing having a mating end and a cable end. The plug housing has a cavity and contact slots open at the mating end. A leadframe assembly is received in the cavity of the plug housing. The leadframe assembly includes a first leadframe having a plurality of first plug contacts, a first commoning pad electrically commoning each of the first plug contacts and a first terminating leg extending from the commoning pad. The first plug contacts are received in corresponding contact slots at the mating end for mating engagement with corresponding mating contacts of a jack. The first terminating leg is configured to be terminated to a first wire of a power cable. The leadframe assembly includes a second leadframe having a plurality of second plug contacts, a second commoning pad electrically commoning each of the second plug contacts and a second terminating leg extending from the commoning pad. The second plug contacts are received in corresponding contact slots at the mating end for mating engagement with corresponding mating contacts of the jack. The second terminating leg is configured to be terminated to a second wire of the power cable. The plug housing and the first and second plug contacts are shaped and positioned to define an RJ-45 modular plug mating interface.

DETAILED DESCRIPTION OF THE INVENTION

Figure 1:
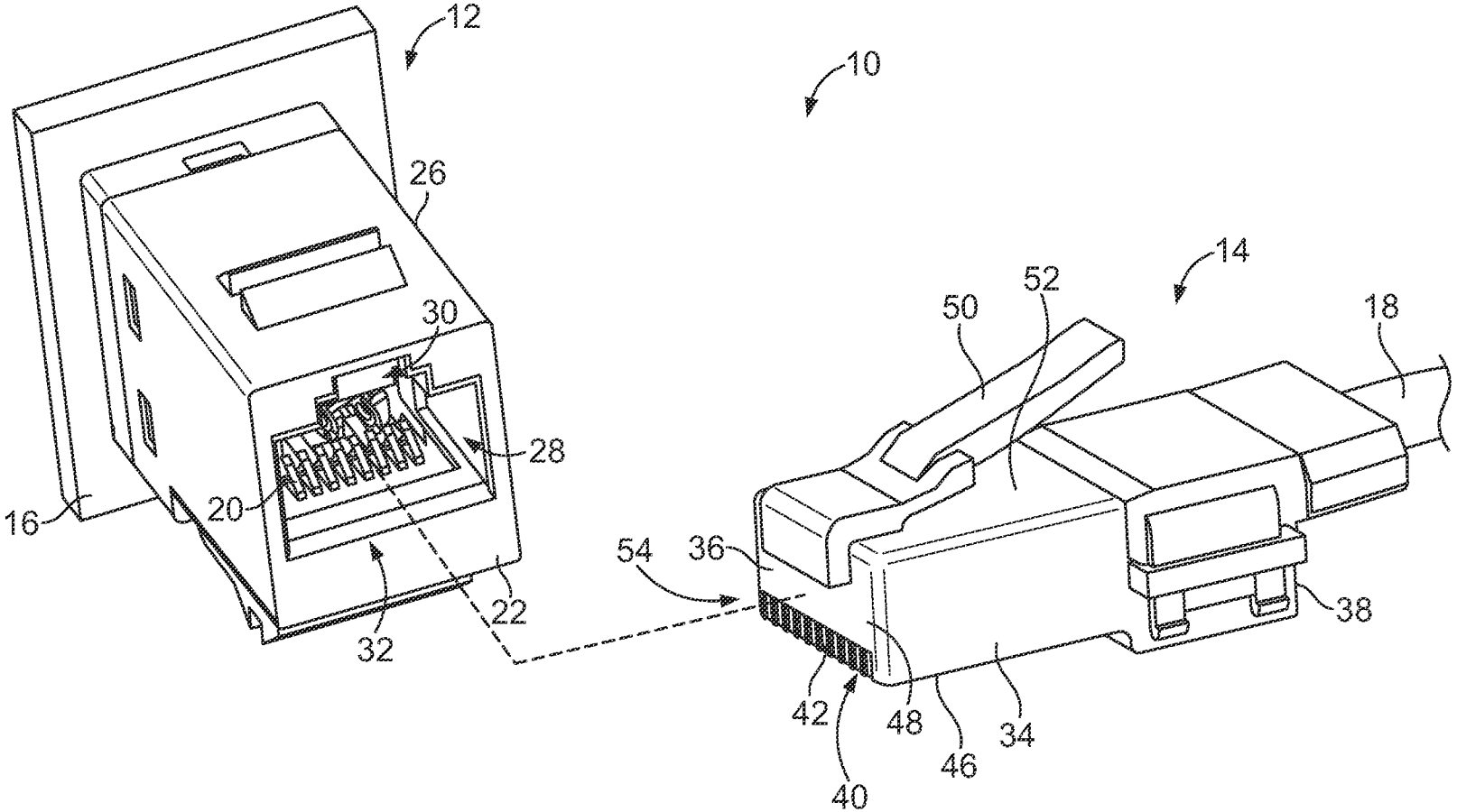
FIG. 1 is a perspective view of an electrical connector system formed in accordance with an exemplary embodiment.

FIG. 1 is a perspective view of an electrical connector system 10 formed in accordance with an exemplary embodiment. The electrical connector system 10 includes a modular jack 12 and a modular plug 14 configured to be mated with the jack 12. The jack 12 and plug 14 may be referred to hereinafter as electrical connector(s). In an exemplary embodiment, the jack 12 is provided on a substrate, such as a printed circuit board 16. The jack 12 may be mounted vertically on the printed circuit board 16, horizontally on the printed circuit board 16 or at other configurations. Optionally, the jack may be a right angle jack with the printed circuit board 16 perpendicular to the mating end. The jack 12 may be mounted on a wall or panel, or, alternatively, may be mounted in an electrical device or apparatus. Alternatively, the jack 12 may be wire or cable mounted at an end of a power cable. In an exemplary embodiment, the plug 14 is provided at an end of a power cable 18 that transmits power to/from the electrical connectors. The jack 12 may be configured as an in-line device, where the jack 12 and corresponding plug 14 are utilized to connect two cables. In an exemplary embodiment, the electrical connector system 10 is used as part of a power application for supplying power to and/or from devices connected to the jack 12 and/or plug 14.

The jack 12 and plug 14 will be described in terms of electrical connectors having components meeting certain requirements of industry standard type RJ-45 connectors, however the jack 12 and plug 14 may have some components that are outside of or do not comply with such industry standards. For example, the size, shape, position and configuration of certain components may comply with the standard, however the electrical connectors are used as power connectors rather than data connectors and thus may have different components to achieve power transmission. In an exemplary embodiment, the electrical connectors have eight contacts, however the eight contacts are used for power transmission rather than data transmission as is typical of RJ-45 connectors.

The jack 12 includes eight mating contacts 20 that are accessible at a mating end 22 to provide a connection interface for the printed circuit board 16. A housing 26 of the jack 12 may be mounted to the printed circuit board 16. In an exemplary embodiment, the eight mating contacts 20 are electrically commoned as part of one or more power circuits. For example, two power circuits may be provided with four mating contacts 20 in each power circuit. The mating contacts 20 are accessed through an opening 28 in the mating end 22 of the housing 26. A locking mechanism 30 extends into opening 28 that is configured to engage a portion of the plug 14 to retain the plug 14 within the jack 12.

In an exemplary embodiment, a mating interface 32 of the jack 12 defines an RJ-45 modular jack mating interface. The mating interface 32 is defined by features, such as, the size and shape of the opening 28, the positioning of the mating contacts 20 in the opening 28, the spacing of the mating contacts 20, the positioning of the locking mechanism 30, and the like.

The plug 14 has a plug housing 34 having a mating end 36 and a cable end 38. The plug housing 34, at the mating end 36, has a substantially similar cross section as the opening 28 of the jack 12. The mating end 36 is plugged into the opening 28 during mating of the plug 14 with the jack 12.

The plug housing 34 includes a plurality of contact slots 40 formed therein at the mating end 36. Plug contacts 42 are located in each of the contact slots 40. Each plug contact 42 is configured to make electrical contact with one of the mating contacts 20 when the plug 14 is inserted into the jack 12. In the illustrated embodiment, the plug 14 includes eight plug contacts 42 that are accessible at the mating end 36 to provide a connection interface for corresponding wires 44 (shown in FIG. 2) of the power cable 18. In an exemplary embodiment, the eight plug contacts 42 are electrically commoned as part of one or more power circuits. For example, two power circuits may be provided with four plug contacts 42 in each power circuit. The plug contacts 42 are accessible along a bottom 46 of the plug housing 34 and/or through a front 48 of the plug housing 34 for mating engagement with corresponding mating contacts 20 of the jack 12.

The plug 14 includes a latch 50 for latching the plug 14 to the jack 12, utilizing the locking mechanism 30 within the jack 12. The latch 50 extends from a top 52 of the plug housing 34 proximate to the mating end 36.

In an exemplary embodiment, a mating interface 54 of the plug 14 defines an RJ-45 modular plug mating interface. The mating interface 54 is defined by features, such as, the size and shape of the exterior of the plug housing 34 at the mating end 36, the positioning of the plug contacts 42 along the plug housing 34, the spacing of the plug contacts 42, the positioning of the latch 50, and the like.

It is to be understood that the benefits described herein are also applicable to other types of electrical connectors, having other standardized mating interfaces, which may carry fewer or greater numbers of contacts in alternative embodiments. The following description is therefore provided for illustrative purposes only and is but one potential application of the subject matter described herein.

Figure 2:
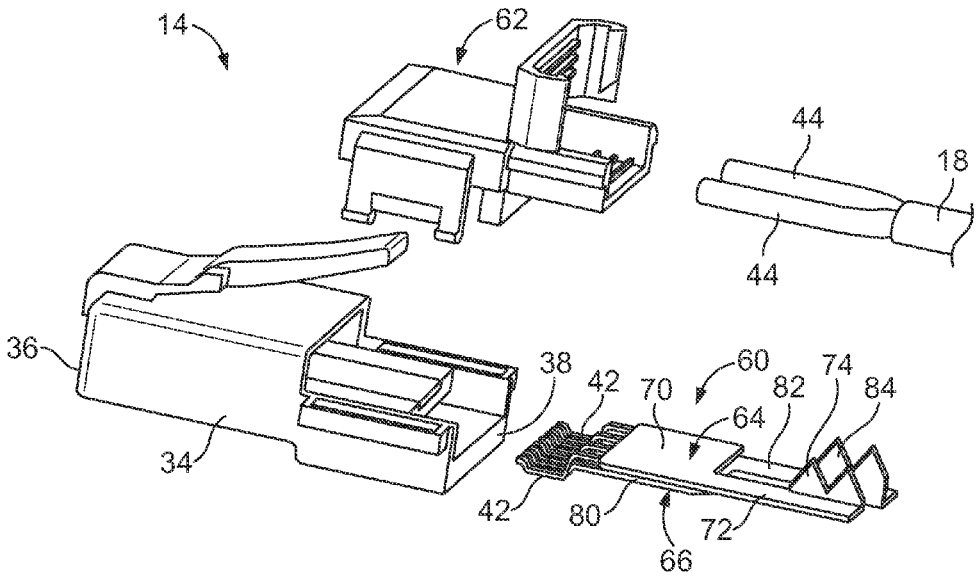
FIG. 2 is an exploded view of a plug for the electrical connector system shown in FIG. 1 and formed in accordance with an exemplary embodiment.

FIG. 2 is an exploded view of the plug 14 formed in accordance with an exemplary embodiment. The plug 14 includes the plug housing 34, a leadframe assembly 60 configured to be received in the plug housing 34 and a stiffer cap 62 configured to receive the wires 44 of the power cable 18 and configured to be coupled to the plug housing 34. The staffer cap 62 is used to electrically connect the wires 44 to the leadframe assembly 60 during assembly. For example, the wires 44 may be pressed into electrical contact with the leadframe assembly 60 when the stuffer cap 62 is coupled to the plug housing 34. In the illustrated embodiment, the stuffer cap 62 is a separate component from the plug housing 34. The stiffer cap 62 is configured to be secured to the plug housing 34 to hold the wires 44 and the power cable 18 with respect to the plug housing 34 and the leadframe assembly 60. In an alternative embodiment, the stuffer cap 62 may be formed integral with the plug housing 34.

The leadframe assembly 60 is configured to be loaded into the plug housing 34. In an exemplary embodiment, the leadframe assembly 60 includes a first leadframe 64 and a second leadframe 66. The first and second leadframes 64, 66 form first and second power circuits for the plug 14. The first and second leadframes 64, 66 are configured to be connected to different wires 44 of the power cable 18.

In an exemplary embodiment, the first leadframe 64 defines a positive terminal of the plug 14 and the second leadframe 66 defines a negative terminal of the plug 14. Different groups of the plug contacts 42 are ganged together by the first and second leadframes 64, 66. For example, in an exemplary embodiment, the plug 14 includes 8 plug contacts 42 with four of the plug contacts 42 defining a first group of plug contacts 42 associated with the first leadframe 64 and four of the plug contacts 42 define a second group of plug contacts 42 that are associated with the second leadframe 66. In an exemplary embodiment, the first leadframe 64 and the second leadframe 66 are vertical stacked with the plug contacts 42 being interested at the mating end 36 of the plug housing 34 when assembled.

The first leadframe 64 includes a commoning pad 70, a plurality of the plug contacts 42 extending forward from the commoning pad 70 and a terminating leg 72 extending rearward from the commoning pad 70. The commoning pad 70 electrically commons the first group of plug contacts 42 together. In an exemplary embodiment, the plug contacts 42 are foamed integral with the commoning pad 70. For example, the plug contacts 42 and the commoning pad 70 may be stamped from a metal sheet to form the leadframe.

The terminating leg 72 is positioned for terminating to the corresponding wire 44 of the power cable 18. In the illustrated embodiment, the terminating leg 72 includes spikes 74 that are configured to pierce the wire 44. The wire 44 may be a stranded wire conductor, or alternatively may be a solid conductor. Other types of terminating features may be provided in alternative embodiments for mechanically and electrically connecting the first leadframe 64 to the wire 44. For example, the terminating leg 72 may include an insulating displacement contact, a crimp barrel, a spring beam, or another type of terminating feature.

The second leadframe 66 includes a commoning pad 80, a plurality of the plug contacts 42 extending forward from the commoning pad 80 and a terminating leg 82 extending rearward from the commoning pad 80. The commoning pad 80 electrically commons the second group of plug contacts 42 together. In an exemplary embodiment, the plug contacts 42 are formed integral with the commoning pad 80. For example, the plug contacts 42 and the commoning pad 80 may be stamped from a metal sheet to form the leadframe.

The terminating leg 82 is positioned for terminating to the corresponding wire 44 of the power cable 18. In the illustrated embodiment, the terminating leg 82 includes spikes 84 that are configured to pierce the wire 44. The wire 44 may be a stranded wire conductor, or alternatively may be a solid conductor. Other types of terminating features may be provided in alternative embodiments for mechanically and electrically connecting the second leadframe 66 to the wire 44. For example, the terminating leg 82 may include an insulating displacement contact, a crimp barrel, a spring beam, or another type of terminating feature.

During assembly, the leadframe assembly 60 is loaded into the plug housing 34. For example, the leadframe assembly 60 may be loaded into the plug housing 34 through the cable end 38. Optionally, the first and second leadframes 64, 66 may be loaded into the plug hosing 34 together as a unit. Alternatively, the first and second leadframes 64, 66 may be separately and individually loaded into the plug housing 34. When the leadframe assembly 60 is loaded into the plug housing 34, the plug contacts 42 are arranged at the mating end 36 of the plug housing 34. The terminating legs 72, 82 are positioned proximate to the cable end 38 of the plug housing 34 for terminating to the wires 44.

Figure 3:
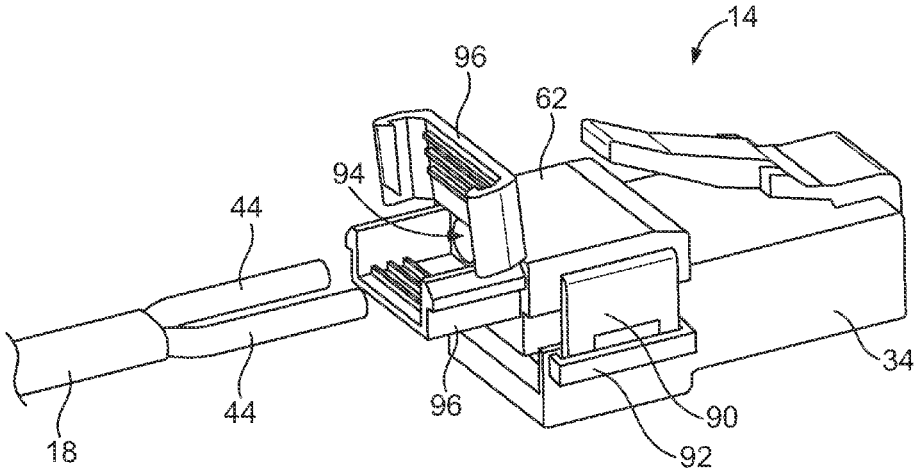
FIG. 3 is a rear perspective view of the plug in a partially assembled state.

FIG. 3 is a rear perspective view of the plug 14 in a partially assembled state. The stuffer cap 62 is aligned with the plug housing 34. Optionally, the stuffer cap 62 may be pre-staged in an open position with respect to the plug housing 34. In the pre-staged, open position, the staffer cap 62 is coupled to the plug housing 34 and is movable with respect to the plug housing 34 in a closing direction such that the sniffer cap 62 may be moved to a closed position with respect to the plug housing 34. The pre-staged, open position allows the relative position of the stuffer cap 62 to be held with respect to the plug housing 34 wherein relative movement between the sniffer cap 62 and the plug housing 34 is controlled or limited in one or more predetermined direction. For example, from the pre-staged, open position, the stuffer cap 62 may be moved vertical downward after the wires 44 are loaded into the stuffer cap 62 to terminate the wires 44 to the leadframe assemblies 60 (shown in FIG. 2).

The stuffer cap 62 includes securing features 90 configured to engage corresponding securing features 92 of the plug housing 34. In the illustrated embodiment, the securing features 90 constitute clips or tabs extending from the sniffer cap 62. In the illustrated embodiment, the securing features 92 constitute openings that receive the securing features 90. The securing features 90, 92 are used to secure the staffer cap 62 to the plug housing 34 in the pre-staged, open position and/or the closed position.

The stuffer cap 62 includes wire channels 94 that receive corresponding wires 44. The wires 44 are loaded into the wire channels 94 in a wire loading direction. Once the wires 44 are fully loaded into the wire channels 94 the stuffer cap 62 may be moved to the closed position. As the sniffer cap 62 is moved to the closed position, the sniffer cap 62 forces the wires 44 into electrical contact with the leadframe assembly 60 by forcing the spikes 74, 84 through insulation of the wires 44.

In an exemplary embodiment, the stuffer cap 62 includes a strain relief feature 96 used to provide strain relief for the power cable 18. In the illustrated embodiment, the strain relief feature 96 includes a lid or cover that may be closed tightly around the power cable 18 to provide strain relief between the power cable 18 and the plug 14. Other types of strain relief features may be provided in alternative embodiments.

Figure 4:
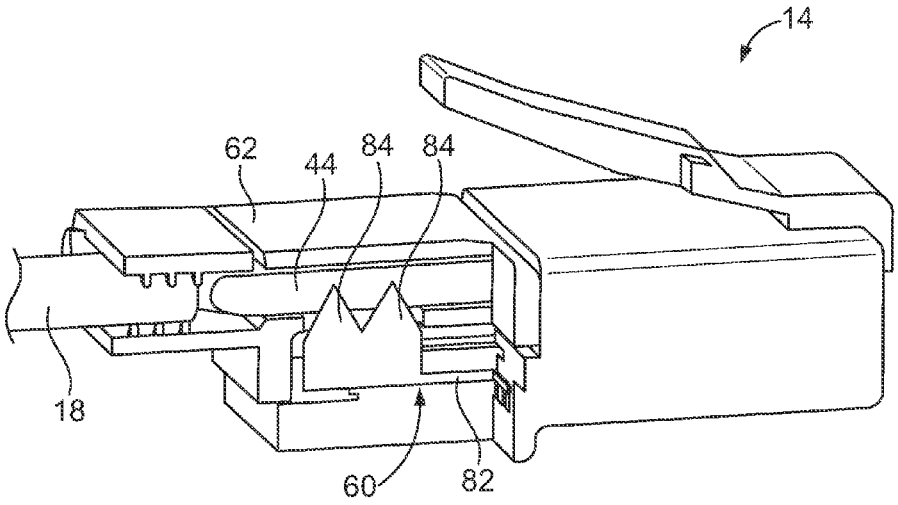
FIG. 4 is a cross sectional view of the plug and wire termination.

FIG. 4 is a cross sectional view of the plug 14 showing the leadframe assembly 60 electrically connected to the power cable 18. The spikes 84 of the terminating leg 82 are shown in FIG. 4 piercing the insulation of the wire 44 of the power cable 18. During assembly, as the stuffer cap 62 is pressed vertically downward toward the plug housing 34, the wires 44 are pressed into electrical contact with the spikes 84. The spikes 84 pierce through the insulation of the wire 44 to create an electrical connection with the conductor of the wire 44.

Figure 5:
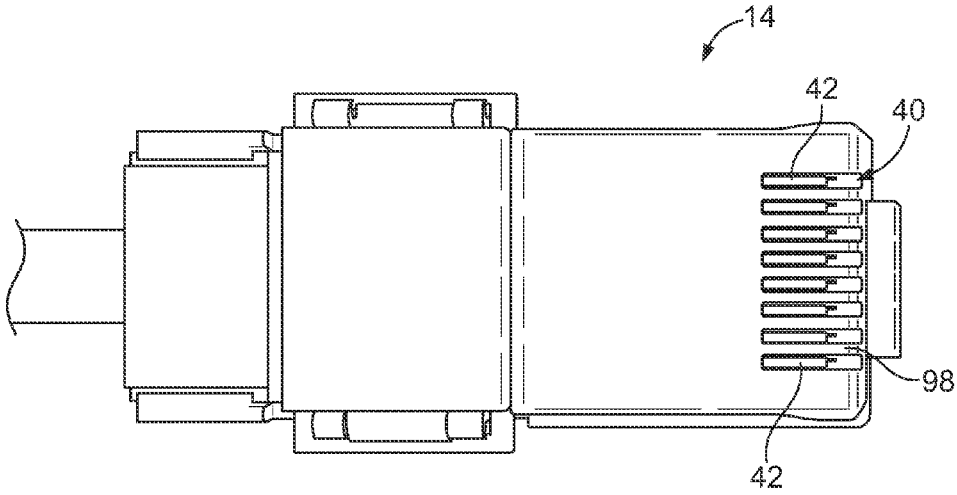
FIG. 5 is a bottom view of the plug.

FIG. 5 is a bottom view of the plug 14. The contact slots 40 and plug contacts 42 are illustrated in FIG. 5. In the illustrated embodiment, eight plug contacts 42 and eight contact slots 40 are provided. Separating walls 98 separate the contact slots 40. In an exemplary embodiment, the eight plug contacts 42 are arranged to define a RJ-45 modular plug connector interface.

Any of the plug contacts 42 may be ganged together depending on the particular application. In an exemplary embodiment, the plug contacts 42 at positions 1, 3, 5, 7 are electrically commoned together as part of the first leadframe 64 (shown in FIG. 2) while the plug contacts 42 at positions 2, 4, 6, 8 are electrically commoned together via the second leadframe 66 (shown in FIG. 2). Alternative configurations are possible in alternative embodiments, such as the plug contacts 42 at positions 1, 2, 3, 4, being electrically commoned while the plug contacts 42 at positions 5, 6, 7, 8 are electrically commoned together by a different leadframe. In other alternative embodiments, more than two leadframes and groups of contacts may be electrically commoned together. In other alternative embodiments, unequal numbers of plug contacts 42 may be electrically commoned by a leadframe. Having many plug contacts 42 electrically commoned together allows higher current caring capability for the plug 14, as compared to electrical connects where only one or two of the plug contacts carry current.

Figure 6:
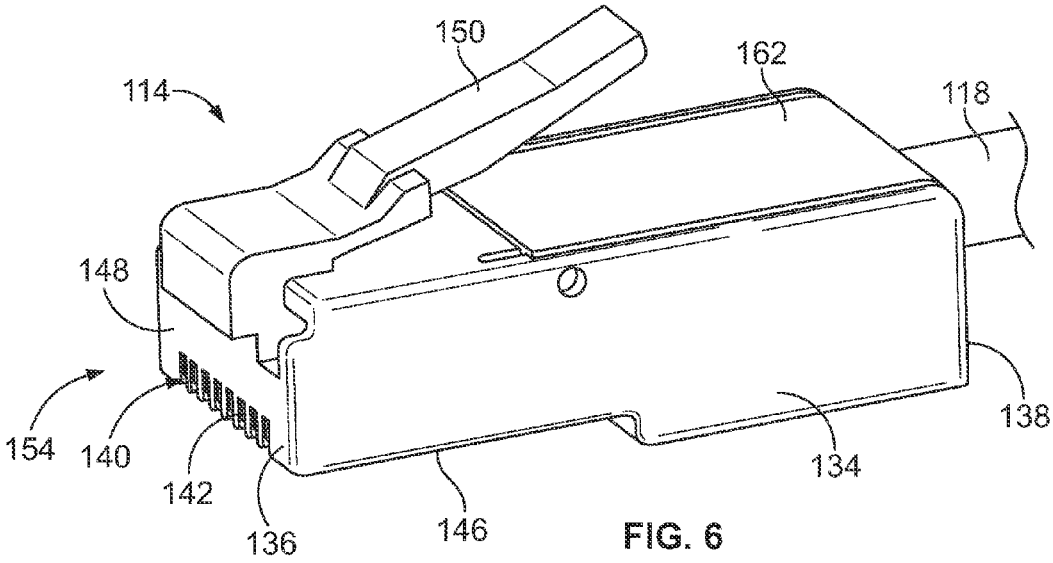
FIG. 6 is a perspective view of a plug formed in accordance with an exemplary embodiment.

FIG. 6 is a perspective view of a modular plug 114 formed in accordance with an exemplary embodiment. The modular plug 114 may be similar to the modular plug 14 (shown in FIG. 1) in some respects and may be mated with the modular jack 12 (shown in FIG. 1). The plug 114 is provided at an end of a power cable 118 that transmit power to/from the electrical connectors. The plug 114 meets certain requirements of industry standard type RJ-45 connectors. For example, the size, shape, position and configuration of certain components may comply with the standard, however the plug 114 is used as power connector rather than a data connector and thus may have different components to achieve power transmission.

The plug 114 has a plug housing 134 having a mating end 136 and a cable end 138. The plug housing 134 includes a plurality of contact slots 140 fowled therein at the mating end 136. Plug contacts 142 are located in each of the contact slots 140. The plug contacts 142 may be substantially similar to the plug contacts 42 (shown in FIG. 2). The plug contacts 142 may be part of a leadframe assembly in a similar manner as the plug contacts 42. In an exemplary embodiment, the plug 114 includes the leadframe assembly 60 (shown in FIG. 2).

In the illustrated embodiment, the plug 114 includes eight plug contacts 142 that are accessible at the mating end 136 to provide a connection interface for corresponding wires 144 (shown in FIG. 7) of the power cable 118. In an exemplary embodiment, the eight plug contacts 142 are electrically commoned as part of one or more power circuits. For example, two power circuits may be provided with four plug contacts 142 in each power circuit. The plug contacts 142 are accessible along a bottom 146 of the plug housing 134 and/or through a front 148 of the plug housing 134 for mating engagement with corresponding the mating contacts 20 of the jack 12.

In an exemplary embodiment, a mating interface 154 of the plug 114 defines an RJ-45 modular plug mating interface. The mating interface 154 is defined by features, such as, the size and shape of the exterior of the plug housing 134 at the mating end 136, the positioning of the plug contacts 142 along the plug housing 134, the spacing of the plug contacts 142, the positioning of a latch 150, and the like.

The plug 114 includes a staffer cap 162 configured to receive the wires 144 of the power cable 118 and configured to be coupled to the plug housing 134. The stuffer cap 162 is used to electrically connect the wires 144 to the leadframe assembly 60 of the plug 114 during assembly. For example, the wires 144 may be pressed into electrical contact with the leadframe assembly 60 when the stuffer cap 162 is coupled to the plug housing 134. In the illustrated embodiment, the staffer cap 162 is pivotably coupled to the plug housing 134. The staffer cap 162 may include pins or posts 164 extending into the plug housing 134 that operate as an axle for the sniffer cap 162. Alternatively, the stuffer cap 162 may be formed integral with the plug housing 134 and is connected thereto at a living hinge.

Figure 7:
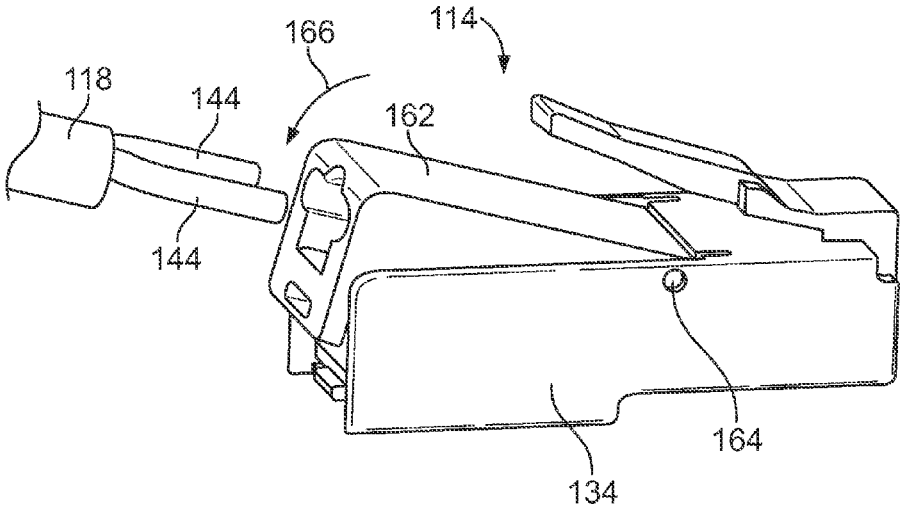
FIG. 7 is a rear perspective view of the plug in a partially assembled state.

FIG. 7 is a rear perspective view of the plug 114 in a partially assembled state. The stuffer cap 162 is partially opened to a pre-staged position with respect to the plug housing 134. The stuffer cap 162 is pivoted in a pivoting closing direction 166 once the wires 144 are loaded therein.

Plugs 14, 114 are provided that define power connectors having RJ-45 mating interfaces. The plug contacts 42, 142 are electrically commoned as part of leadframes that define power terminals of the plugs 14, 114. Having many plug contacts 42, 142 electrically commoned together allows higher current caring capability for the plugs 14, 114, as compared to electrical connects where only one or two of the plug contacts carry current.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A modular plug comprising:

a plug housing having a mating end and a cable end;

plug contacts at the mating end;

wherein the plug housing and the plug contacts are shaped and positioned to define an RJ-45 modular plug mating interface;

the plug contacts being arranged into a first group and a second group, each of the plug contacts in the first group being electrically commoned to form a first power circuit, each of the plug contacts in the second group being electrically commoned to form a second power circuit, the first and second power circuits being terminated to different wires of a cable.

2. The modular plug of claim 1, wherein the first and second groups of plug contacts each include at least three or more plug contacts.

3. The modular plug of claim 1, wherein eight plug contacts are provided with four plug contacts in the first group and four plug contacts in the second group.

4. The modular plug of claim 1, wherein the plug contacts are aligned and are equally spaced along the mating end, the plug contacts being exposed for mating engagement with corresponding mating contacts of a jack.

5. The modular plug of claim 1, wherein the plug housing includes a latch extending from a top of the plug housing proximate to the mating end, the plug contacts being exposed along a bottom of the plug housing for mating engagement with corresponding mating contacts of a jack.

6. The modular plug of claim 1, further comprising a staffer cap coupled to the plug housing, the stiffer cap having wire channels configured to receive different wires of the cable, the sniffer cap being movable relative to the plug housing to press the wires into electrical contact with the first and second power circuits when the stuffer cap is closed onto the plug housing.

7. The modular plug of claim 6, wherein the stuffer cap is pivotally coupled to the plug housing, the stuffer cap being pivoted closed.

8. The modular plug of claim 6, wherein the staffer cap includes a securing feature coupled to the plug housing to secure the stuffer cap to the plug housing.

9. The modular plug of claim 1 further comprising a first commoning pad and a second commoning pad, the first commoning pad electrically commoning the plug contacts of the first group, the second commoning pad electrically commoning the plug contacts of the second group.

10. The modular plug of claim 9, wherein the plug contacts of the first group are integrally formed with the first commoning pad, the plug contacts of the second group being integrally formed with the second commoning pad.

11. The modular plug of claim 9, wherein the plug contacts of the first group and the first commoning pad are stamped from a first leadframe, and wherein the plug contacts of the second group and the second commoning pad are stamped from a second leadframe.

12. The modular plug of claim 9, wherein the first commoning pad includes a first terminating leg extending therefrom configured to be terminated to the corresponding wire of the cable, and wherein the second commoning pad includes a second terminating leg extending therefrom configured to be terminated to the corresponding wire of the cable.

13. A modular plug comprising:

a plug housing having a mating end and a cable end, the plug housing having a cavity;

a leadframe assembly received in the cavity of the plug housing, the leadframe assembly having a first leadframe having a plurality of first plug contacts, the first plug contacts being electrically commoned to form a first power circuit, the first leadframe being configured to be terminated to a first wire of a power cable, the leadframe assembly having a second leadframe having a plurality of second plug contacts, the second plug contacts being electrically commoned to form a second power circuit, the second leadframe being configured to be terminated to a second wire of the power cable;

wherein the first and second plug contacts are positioned at the mating end of the plug housing to define an RJ-45 modular plug mating interface.

14. The modular plug of claim 13, further comprising a stuffer cap coupled to the plug housing, the stuffer cap having wire channels configured to receive different wires of the cable, the stuffer cap being movable relative to the plug housing to press the wires into electrical contact with the first and second power circuits when the sniffer cap is closed onto the plug housing.

15. The modular plug of claim 13, wherein the first leadframe includes a first commoning pad and the second leadframe includes a second commoning pad, the first commoning pad electrically commoning the plug contacts of the first group, the second commoning pad electrically commoning the plug contacts of the second group.

16. The modular plug of claim 15, wherein the plug contacts of the first group are integrally formed with the first commoning pad, the plug contacts of the second group being integrally formed with the second commoning pad.

17. The modular plug of claim 15, wherein the first leadframe includes a first terminating leg extending from the first commoning pad configured to be terminated to the corresponding wire of the cable, and wherein the second leadframe includes a second terminating leg extending from the second commoning pad configured to be terminated to the corresponding wire of the cable.

18. A modular plug comprising:

a plug housing having a mating end and a cable end, the plug housing having a cavity, the plug housing having contact slots open at the mating end; and a leadframe assembly received in the cavity of the plug housing, the leadframe assembly comprising:

a first leadframe having a plurality of first plug contacts, a first commoning pad electrically commoning each of the first plug contacts and a first terminating leg extending from the commoning pad, the first plug contacts being received in corresponding contact slots at the mating end for mating engagement with corresponding mating contacts of a jack, the first terminating leg being configured to be terminated to a first wire of a power cable; and a second leadframe having a plurality of second plug contacts, a second commoning pad electrically commoning each of the second plug contacts and a second terminating leg extending from the second commoning pad, the second plug contacts being received in corresponding contact slots at the mating end for mating engagement with corresponding mating contacts of the jack, the second terminating leg being configured to be terminated to a second wire of the power cable;

wherein the plug housing and the first and second plug contacts are shaped and positioned to define an RJ-45 modular plug mating interface.

19. The modular plug of claim 18, further comprising a sniffer cap coupled to the plug housing, the staffer cap having wire channels configured to receive different wires of the cable, the sniffer cap being movable relative to the plug housing to press the wires into electrical contact with the first and second leadframes when the stuffer cap is closed onto the plug housing.

20. The modular plug of claim 18, wherein the plug contacts of the first group are integrally formed with the first commoning pad, the plug contacts of the second group being integrally formed with the second commoning pad.

* * * * *